US007355570B2

(12) United States Patent
Choi

(10) Patent No.: US 7,355,570 B2
(45) Date of Patent: Apr. 8, 2008

(54) METHOD OF EXPRESSING GRAY LEVEL OF HIGH LOAD IMAGE AND PLASMA DISPLAY PANEL DRIVING APPARATUS USING THE METHOD

(75) Inventor: Im-Su Choi, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 708 days.

(21) Appl. No.: 10/962,624

(22) Filed: Oct. 13, 2004

(65) Prior Publication Data

US 2005/0083258 A1 Apr. 21, 2005

(30) Foreign Application Priority Data

Oct. 21, 2003 (KR) ..... 10-2003-0073513

(51) Int. Cl.
*G09G 3/10* (2006.01)

(52) U.S. Cl. ..... 345/63; 345/60; 345/77; 345/89; 345/690; 315/169.1; 315/169.4; 348/631; 348/637

(58) Field of Classification Search ..... 345/41, 345/42, 60, 63, 77, 89, 311, 212, 596, 690; 315/169.1, 169.4; 348/631, 671
See application file for complete search history.

(56) References Cited

U.S. PATENT DOCUMENTS 5,541,618 A 7/1996 Shinoda
5,661,500 A 8/1997 Shinoda et al.
5,663,741 A 9/1997 Kanazawa
5,674,553 A 10/1997 Shinoda et al.
5,724,054 A 3/1998 Shinoda
5,786,794 A 7/1998 Kishi et al.
5,952,782 A 9/1999 Nanto
6,268,890 B1 * 7/2001 Kawahara ..... 348/739
RE37,444 E 11/2001 Kanazawa
6,326,938 B1 * 12/2001 Ishida et al. ..... 345/63
6,630,916 B1 10/2003 Shinoda
6,707,436 B2 3/2004 Setoguchi et al.
6,788,306 B2 * 9/2004 Yamaguchi et al. ..... 345/596
2002/0105491 A1 * 8/2002 Yamaguchi et al. ..... 345/89

FOREIGN PATENT DOCUMENTS

JP 02-148645 6/1990
JP 2845183 10/1998
JP 2917279 4/1999

(Continued)

*Primary Examiner*—Bipin Shalwala
*Assistant Examiner*—Vincent E. Kovalick
(74) *Attorney, Agent, or Firm*—Robert E. Bushnell, Esq.

(57) ABSTRACT

In a method of expressing a gray level of a high load image and an apparatus for driving a Plasma Display Panel (PDP) using the method, a load ratio of the input image signal is calculated, and an error diffusion of a lower bit of gray level data corresponding to the input image signal is performed when it has been determined that the calculated load ratio is greater than or equal to a critical load ratio which is a lowest load ratio among the load ratios in which luminance at every gray level does not increase while the gray level increases at a low gray level area. The error-diffused gray level data is then displayed on the PDP.

14 Claims, 7 Drawing Sheets

FOREIGN PATENT DOCUMENTS

| | | |
|---|---|---|
| JP | 11-231833 | 8/1999 |
| JP | 2001-043804 | 2/2001 |
| JP | 2001-109452 | 4/2001 |
| JP | 2001-154630 | 6/2001 |
| JP | 2001-325888 | 11/2001 |
| JP | 2003-15588 | 1/2003 |
| JP | 2003-195801 | 7/2003 |
| KR | 10-2003-0020210 | 3/2003 |
| KR | 10-2003-0043344 | 6/2003 |

* cited by examiner

| gray level | SF mapping | illuminating amount |
|---|---|---|
| 0 | 0 | 0 |
| 1 | SF0 | 1addr + 1sus |
| 2 | SF1 | 1addr + 4sus |
| 3 | SF0 + SF2 | 2addr + 5sus |
| 4 | SF3 | 1addr + 8sus |
| ⋮ | ⋮ | ⋮ |

gradual luminance increase

| gray level | SF map | illuminating amount |
|---|---|---|
| 0 | 0 | 0 |
| 1 | SF0 | 1addr + 1sus |
| 2 | SF1 | 1addr + 1sus |
| 3 | SF0 + SF2 | 2addr + 2sus |
| 4 | SF3 | 1addr + 4sus |
| ⋮ | ⋮ | ⋮ |

no increase small increase gray level breakdown due to the gray level with no increase

| gray level | SF map | illuminating amount |
|---|---|---|
| 0 | 0 | 0 |
| 1 | SF0 | 1addr + 1sus |
| 2 | SF1 | 1addr + 1sus |
| 3 | SF0 + SF2 | 2addr + 2sus |
| 4 | SF3 | 1addr + 4sus |
| ⋮ | ⋮ | ⋮ |

Fig. 6A1
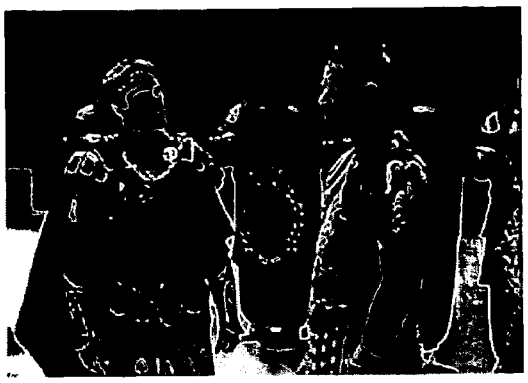
Fig. 6A2
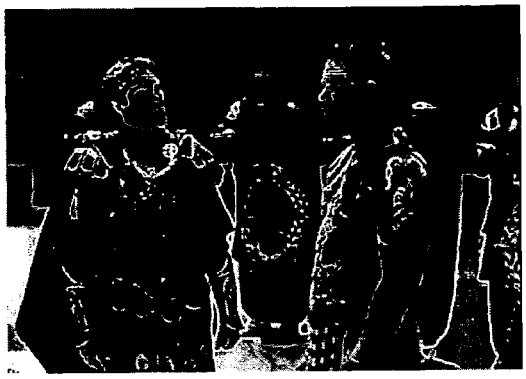
Fig. 6B1
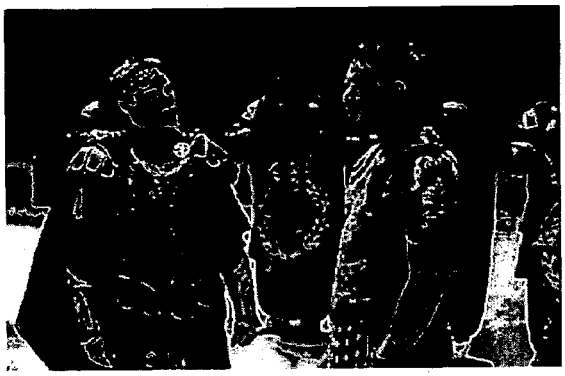
Fig. 6B2
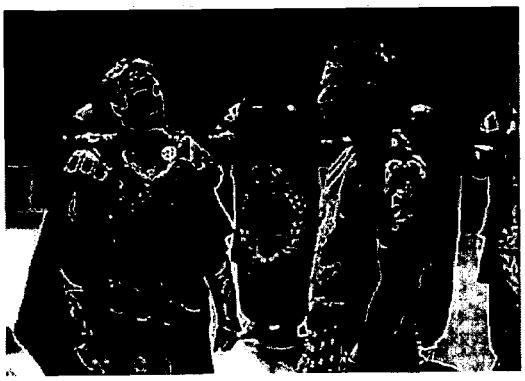

METHOD OF EXPRESSING GRAY LEVEL OF HIGH LOAD IMAGE AND PLASMA DISPLAY PANEL DRIVING APPARATUS USING THE METHOD

CLAIM FOR PRIORITY

This application makes reference to, incorporates the same herein, and claims all benefits accruing under 35 U.S.C. § 119 from an application for METHOD FOR EXPRESSING GRAY LEVEL OF HIGH LOAD IMAGE AND PLASMA DISPLAY PANEL DRIVING APPARATUS USING THE SAME earlier filed in the Korean Intellectual Property Office on Oct. 21, 2003 and there duly assigned Serial No. 10-2003-0073513.

BACKGROUND OF THE INVENTION

1. Field of the Invention

The present invention relates to a method of expressing a gray level of a high load image and a driving apparatus for a Plasma Display Panel (hereinafter, referred to as a PDP) using the method, and more particularly, to a method of expressing a gray level of a high load image and a PDP driving apparatus using the method that improves the characteristics to express a low gray level in displaying the high load image.

2. Description of the Related Art

A PDP is a display device that displays image data inputted as an electrical signal by selectively illuminating discharge cells arranged in a matrix form.

Such a PDP should be able to express gray levels in order to function as a color display device, and a gray level expressing method by time-division control of a plurality of subfields created by the division of one field is employed to realize the gray level expression.

Since the PDP consumes a great deal of electrical power, Automatic Power Control (hereinafter referred to as APC) technology is used to control the power consumption according to the average signal level or a load ratio of a frame to be displayed. In the APC technology, APC levels are changed according to the load ratio of the image data corresponding to the input image, and the power consumption is confined to a certain level while the number of sustain pulses is changed at every APC level.

In general, according to the APC technology, as the load ratio of the input image decreases, the power consumption decreases and therefore a relatively large number of sustain pulses can be used, and accordingly, the number of sustain pulses assigned to the respective subfields also increases. On the contrary, as the load ratio of the input image increases, the power consumption increases and a relatively small number of sustain pulses must be used to reduce the power consumption, and accordingly, the number of sustain pulses assigned to the respective subfields also decreases.

In order to express a gray level of the image of a low load, one sustain pulse is assigned to a subfield SF0 of the lowest significance, i.e. the least significant bit (LSB) subfield, four sustain pulses are assigned to a subfield SF1 of the second lowest significance, i.e. a 2nd LSB subfield, and eight and sixteen sustain pulses are respectively assigned to a subfield SF2 of the third lowest significance, i.e. a 3rd LSB subfield, and a subfield SF3 of the fourth lowest significance, i.e. a 4th LSB subfield. In such a situation, the number of sustain pulses varies according to the APC level.

When the gray level is 0, the illuminating amount is also 0 as there is no mapped subfield. However, when the gray level is 1, the LSB subfield SF0 is mapped and the illuminating amount in that situation is determined by the sum of the illuminating amount 1addr corresponding to one address section and the illuminating amount 1sus by one sustain pulse. Furthermore, when the gray level is 2, the second LSB subfield SF1 is mapped, and the illuminating amount is determined by the sum of the illuminating amount 1addr corresponding to one address section and the illuminating amount 4sus by four sustain pulses. Moreover, the gray level 3 is mapped to the second LSB subfield SF1, and the illuminating amount is determined by 1addr+5sus. Other gray levels are mapped according to such a manner, and the illuminating amounts are determined by the mapped subfields.

The illuminating amount determined by the subfield mapping of every gray level, especially the illuminating amount determined at the low gray levels from 0 to 4, increases gradually as the gray level increases. Therefore, it can be understood that the linearity of gray level is maintained in the case of low load image.

In the case of a high load image of a PDP, the number of sustain pulses assigned to all subfields decreases for the suppression of the power consumption at the high load image, and in such a situation, one sustain pulse is assigned to the LSB subfield SF0 as well as to the 2nd LSB subfield SF1 for the expression of gray level of the corresponding image, and four and eight sustain pulses are respectively assigned to the 3rd LSB subfield SF2 and 4th LSB subfield SF3. In that situation, the number of sustain pulses assigned to the respective subfields are converted according to the APC level.

When the gray level is 0, the illuminating amount is also 0 as there is no mapped subfield. However, the gray level of 1 is mapped to the LSB subfield SF0 and the illuminating amount in that situation is determined by 1addr+1sus, the gray level 2 is mapped to the second LSB subfield SF1 and the illuminating amount in that situation is determined by 1addr+1sus, and the gray level 3 is mapped to the LSB subfield SF0 and the 2nd LSB subfield SF1 and the illuminating amount in that situation is determined by 2addr+2sus. Other gray levels are mapped according to such a manner, and the illuminating amounts are determined by the mapped subfields.

The illuminating amount determined by the subfield mapping of every gray level, especially the illuminating amount determined at the low gray levels from 0 to 4, does not increase gradually as the gray level increases. Comparing gray level 1 with gray level 2, even though the gray level increases, the illuminating amount does not increases since the number of sustain pulses assigned to the LSB subfield and the 2nd LSB subfield are identical to each other. Furthermore, comparing the gray level 2 with gray level 3, the increment of illuminating amount at the gray levels is relatively small even through the gray level increases gradually. The illuminating amount does not increase at all or increases a little even through the gray level increases such as from gray level 1 to gray level 3, so the gray level can not be expressed properly in expressing the low gray level at the high load image.

In the PDP described above, the number of sustain pulses is reduced to lower the power consumption at the high load image when the APC technology is adopted, which can cause a deterioration of the linearity of the gray level when the number of sustain pulses becomes extremely low or the integral multiple number of sustain mapping cannot be formed, and therefore causes a breakdown in expressing the gray level.

SUMMARY OF THE INVENTION

The present invention has been proposed to overcome the problem noted above, and it is an object of the present invention to provide a method of expressing a gray level of a high load image and a plasma display panel driving apparatus using the method, which can prevent a breakdown in expressing a gray level of a high load image that has a problem in that the linearity of the gray level is deteriorated by changing an error diffusion algorithm for the gray level expression of the high load image.

In accordance with one aspect of the present invention, a method of expressing gray level on a plasma display panel is provided, the method comprising: dividing an image of each field displayed on the plasma display panel in accordance with an input image signal into a plurality of different subfields and expressing the gray level by a combination of the different subfields; calculating a load ratio of the input image signal; performing error diffusion of a lower bit of the gray level data corresponding to the input image signal upon a determination that the calculated load ratio is greater than or equal to a critical load ratio which is a lowest load ratio among the load ratios in which luminance at every gray level does not increase while the gray level increases at a low gray level area; and displaying the error-diffused gray level data on the plasma display panel.

The luminance corresponding to the Least Significant Bit (LSB) gray level and the luminance corresponding to the 2nd LSB gray level are preferably equal to each other at the critical load ratio.

The method preferably further comprises generating gray level data corresponding to the input image signal by correcting a gamma value of the input image signal in accordance with a characteristic of the plasma display panel, after calculating the load ratio of the input image signal.

The method preferably further comprises generating a gray level data corresponding 11 to the input image signal by correcting a gamma value of the input image signal in accordance with a characteristic of the plasma display panel, after calculating the load ratio of the input image signal.

Performing error diffusion of a lower bit of the gray level data preferably comprises: converting the gray level data to remove the LSB of the gray level data; and performing error diffusion of the converted gray level data.

Converting the gray level data preferably comprises: shifting the gray level data in a direction toward the LSB; and inputting zero to a Most Significant Bit (MSB) of the gray level data.

The method preferably further comprises re-converting the gray level data after the error diffusion has been performed to set the LSB of the error-diffused gray level data equal to zero.

In accordance with another aspect of the present invention, an apparatus for expressing a gray level on a plasma display panel is provided, the apparatus comprising: a gamma corrector adapted to correcting a gamma value of an input image signal in accordance with a characteristic of the plasma display panel to output gray level data corresponding to the image signal; an Automatic Power Control (APC) unit adapted to detect a load ratio of the gray level data output from the gamma corrector, to calculate an APC level based on the detected load ratio, to calculate and output a number of sustain pulses corresponding to the calculated APC level and the numbers of sustain pulses assigned to respective subfields, to compare the calculated APC level with a critical APC level equal to a lowest APC level among APC levels in which luminance at every gray level does not increase while the gray level increases at a low gray level area, and to output the comparison result; an error diffuser adapted to performing error diffusion of the gray level data output from the gamma corrector according to the comparison result, wherein gray level data corresponding to a Least Significant Bit (LSB) of the image signal is included in the error-diffused gray level data upon a determination that the calculated APC level is greater than or equal to the critical APC level according to the comparison result; and a driver adapted to receive the APC level and the number of sustain pulses output from the APC unit and the gray level data output from the error diffuser, to generate signals to display an image corresponding to the image signal on the plasma display panel, and to supply the generated signals to the plasma display panel.

The driver preferably comprises: a sustain pulse driver adapted to generate a subfield arrangement according to the APC level and the number of sustain pulses output from the APC unit, to generate a control signal based on the generated subfield arrangement, and to supply the generated control signal to the plasma display panel; and a memory controller adapted to receive the gray level data output from the error diffuser, to generate the subfield data corresponding to the subfield arrangement generated by the sustain pulse driver, and to supply the generated subfield data to the plasma display panel.

The error diffuser is preferably adapted to perform the error diffusion after shifting the gray level data output from the gamma corrector in a direction toward the LSB by one bit to include the gray level data corresponding to the LSB of the image signal in the error diffusion.

The error diffuser is preferably adapted to shift the error-diffused gray level data again in a direction toward a Most Significant Bit (MSB) by one bit to restore all of the gray level data except the LSB.

In accordance with yet another aspect of the present invention, a method of expressing a gray level on a plasma display panel is provided, the method comprising: dividing an image of each field displayed on the plasma display panel in accordance with an input image signal to a plurality of different subfields; expressing the gray level by a combination of the different subfields; calculating a load ratio of the input image signal; determining whether a luminance at every gray level determined according to the calculated load ratio increases linearly according to a gradual increase of the gray level at a low gray level area; performing error diffusion of the gray level data excluding the gray level data mapped commonly to the gray level corresponding to the luminance that does not increase linearly, upon a determination that the luminance at every gray level does not increase linearly according to a gradual increase of the gray level at a low gray level area; and displaying the error-diffused gray level data on the plasma display panel.

A determination is preferably made that the luminance corresponding to a Least Significant Bit (LSB) gray level among the gray levels determined according to the calculated load ratio is equal to the luminance corresponding to the 2nd LSB gray level, to determine whether a luminance at every gray level determined according to the calculated load ratio increases linearly according to a gradual increase of the gray level at a low gray level area.

The error diffusion is preferably performed with respect to the gray level data 11 excluding the LSB upon the luminance corresponding to the LSB gray level being equal to the luminance corresponding to the 2nd LSB gray level.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein:

FIGS. 6A1 and 6A2 are views of respective examples of real images that are displayed before and after the gray level expressing method according to an embodiment of the present invention is adopted for a low load image;

FIGS. 6B1 and 6B2 are views of respective examples of real images that are displayed before and after the gray level expressing method according to an embodiment of the present invention is adopted for a high load image.

DETAILED DESCRIPTION OF THE INVENTION

Figures 1A, 1B:
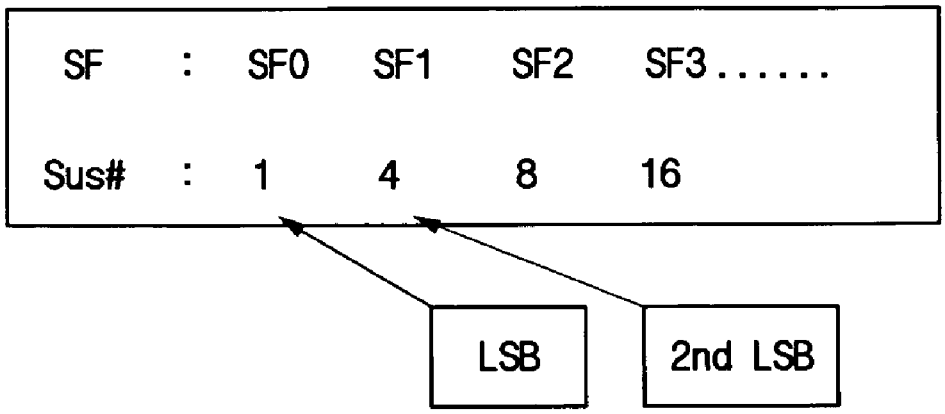
FIGS. 1A and 1B are views of respective examples of an assignment of a number of sustain pulses at every subfield according to APC technology and mapping for every gray level, in the case of a low load image of a PDP.

FIGS. 1A and 1B are views of respective examples of an assignment of a number of sustain pulses at every subfield according to APC technology and mapping for every gray level, in the case of a low load image of a PDP.

Referring to FIG. 1A, in order to express a gray level of the image of a low load, one sustain pulse is assigned to the subfield SF0 of the lowest significance, i.e. the least significant bit (LSB) subfield, four sustain pulses are assigned to the subfield SF1 of the second lowest significance, i.e. the 2nd LSB subfield, and eight and sixteen sustain pulses are respectively assigned to the subfield SF2 of the third lowest significance, i.e. the 3rd LSB subfield, and the subfield SF3 of the fourth lowest significance, i.e. the 4th LSB subfield. In such a situation, the number of sustain pulses varies according to the APC level.

FIG. 1B is a view of the illuminating amount at every gray level, and the subfield mapping corresponding to the respective gray levels of corresponding low load images when the number of sustain pulses are assigned at every subfield as shown in FIG. 1A at the low load image. For example, when the gray level is 0, the illuminating amount is also 0 as there is no mapped subfield. However, when the gray level is 1, the LSB subfield SF0 is mapped and the illuminating amount in that situation is determined by the sum of the illuminating amount 1addr corresponding to one address section and the illuminating amount 1sus by one sustain pulse. Furthermore, when the gray level is 2, the second LSB subfield SF1 is mapped, and the illuminating amount is determined by the sum of the illuminating amount 1addr corresponding to one address section and the illuminating amount 4sus by four sustain pulses. Moreover, the gray level 3 is mapped to the second LSB subfield SF1, and the illuminating amount is determined by 1addr+5sus. Other gray levels are mapped according to such a manner, and the illuminating amounts are determined by the mapped subfields.

As can be seen from FIG. 1B, the illuminating amount determined by the subfield mapping of every gray level, especially the illuminating amount determined at the low gray levels from 0 to 4, increases gradually as the gray level increases. Therefore, the gray level linearity is maintained in the case of a low load image.

Figures 2A, 2B:
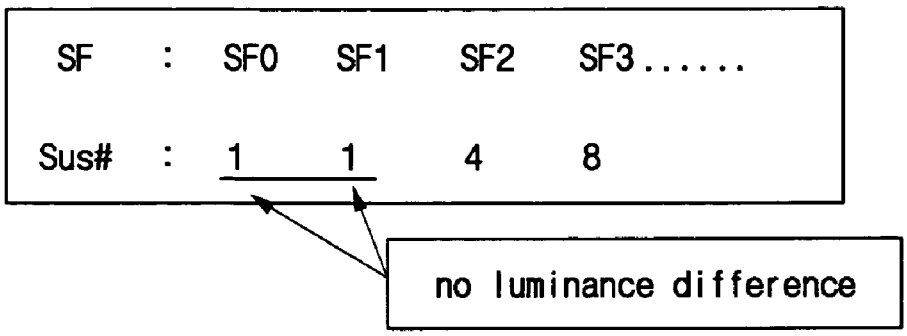
FIGS. 2A and 2B are views of respective examples of an assignment of a number of sustain pulses at every subfield according to APC technology and mapping for every gray level, in the case of a high load image of a PDP.

FIGS. 2A and 2B are views of respective examples of an assignment of a number of sustain pulses at every subfield according to APC technology and mapping for every gray level, in the case of a high load image of a PDP.

Referring FIG. 2A, the number of sustain pulses assigned to all subfields decreases for the suppression of the power consumption at the high load image, and in such a situation, one sustain pulse is assigned to the LSB subfield SF0 as well as to the 2nd LSB subfield SF1 for the expression of gray level of the corresponding image, and four and eight sustain pulses are respectively assigned to the 3rd LSB subfield SF2 and 4th LSB subfield SF3. In that situation, the number of sustain pulses assigned to the respective subfields are converted according to the APC level.

FIG. 2B is a view of the illuminating amount at every gray level, and the subfield mapping corresponding to the respective gray levels of corresponding high load images when the number of sustain pulses are assigned at every subfield as shown in FIG. 2A at the high load image. For example, when the gray level is 0, the illuminating amount is also 0 as there is no mapped subfield. However, the gray level of 1 is mapped to the LSB subfield SF0 and the illuminating amount in that situation is determined by 1addr+1sus, the gray level 2 is mapped to the second LSB subfield SF1 and the illuminating amount in that situation is determined by 1addr+1sus, and the gray level 3 is mapped to the LSB subfield SF0 and the 2nd LSB subfield SF1 and the illuminating amount in that situation is determined by 2addr+2sus. Other gray levels are mapped in such a manner, and the illuminating amounts are determined by the mapped subfields.

As can be seen from FIG. 2B, the illuminating amount determined by the subfield mapping of every gray level, especially the illuminating amount determined at the low gray levels from 0 to 4, does not increase gradually as the gray level increases. Comparing gray level 1 with gray level 2, even though the gray level increases, the illuminating amount does not increases since the number of sustain pulses assigned to the LSB subfield and the 2nd LSB subfield are identical to each other. Furthermore, comparing the gray level 2 with gray level 3, the increment of illuminating amount at the gray levels is relatively small even through the gray level increases gradually.

Figure 3:
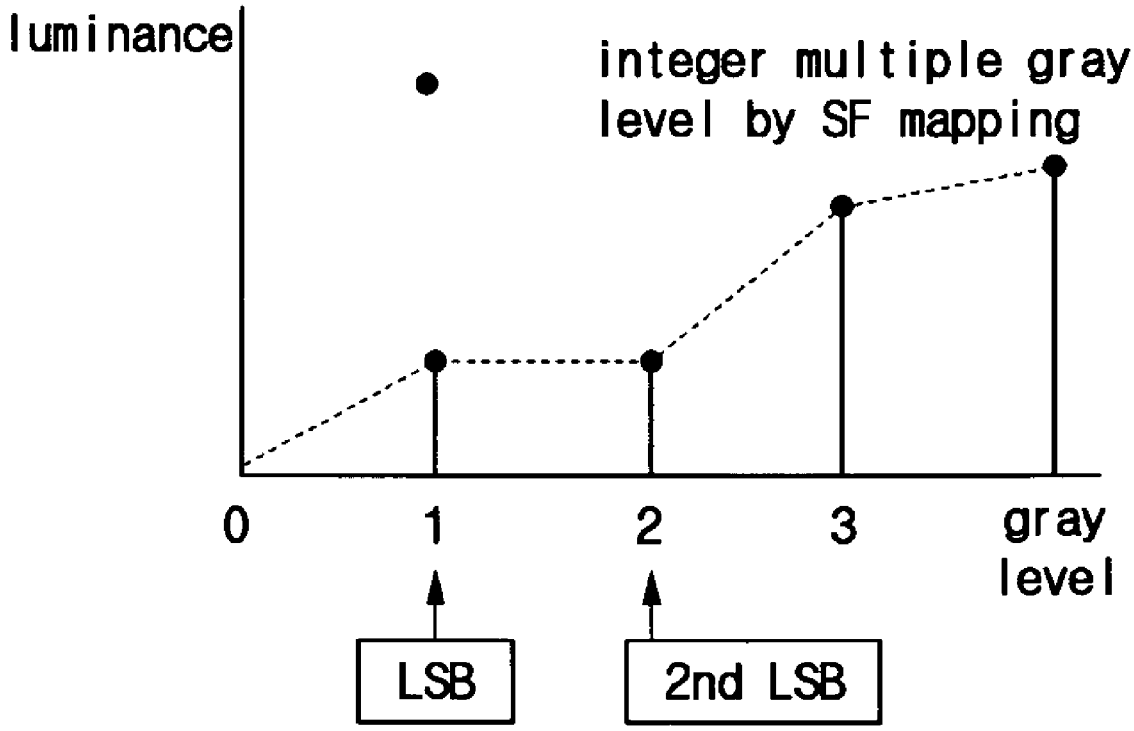
FIG. 3 is a graph of an increase in luminance with respect to an increase in gray level in a PDP.

FIG. 3 is a view of the illuminating amount, i.e. luminance, determined at each gray level, which illustrates the increasing of illuminating amount, i.e. luminance, according to the increase of the gray level. As can be seen from FIG. 3, the illuminating amount does not increase at all or increases only a small amount even through the gray level increases such as from gray level 1 to gray level 3, so the gray level can not be expressed properly in expressing the low gray level at the high load image.

In the following detailed description, an exemplary embodiment of the present invention has been shown and described, simply by way of illustration. As will be realized, the present invention is capable of modification in various respects, all without departing from the spirit and scope of the present invention. Accordingly, the drawings and description are to be regarded as illustrative in nature, and not restrictive.

To clarify the present invention, parts which are not described in the specification have been omitted, and the same or similar parts have the same reference numerals.

Hereinafter, the exemplary embodiment of the present invention will be described in greater detail with reference to the accompanying drawings.

Figure 4:
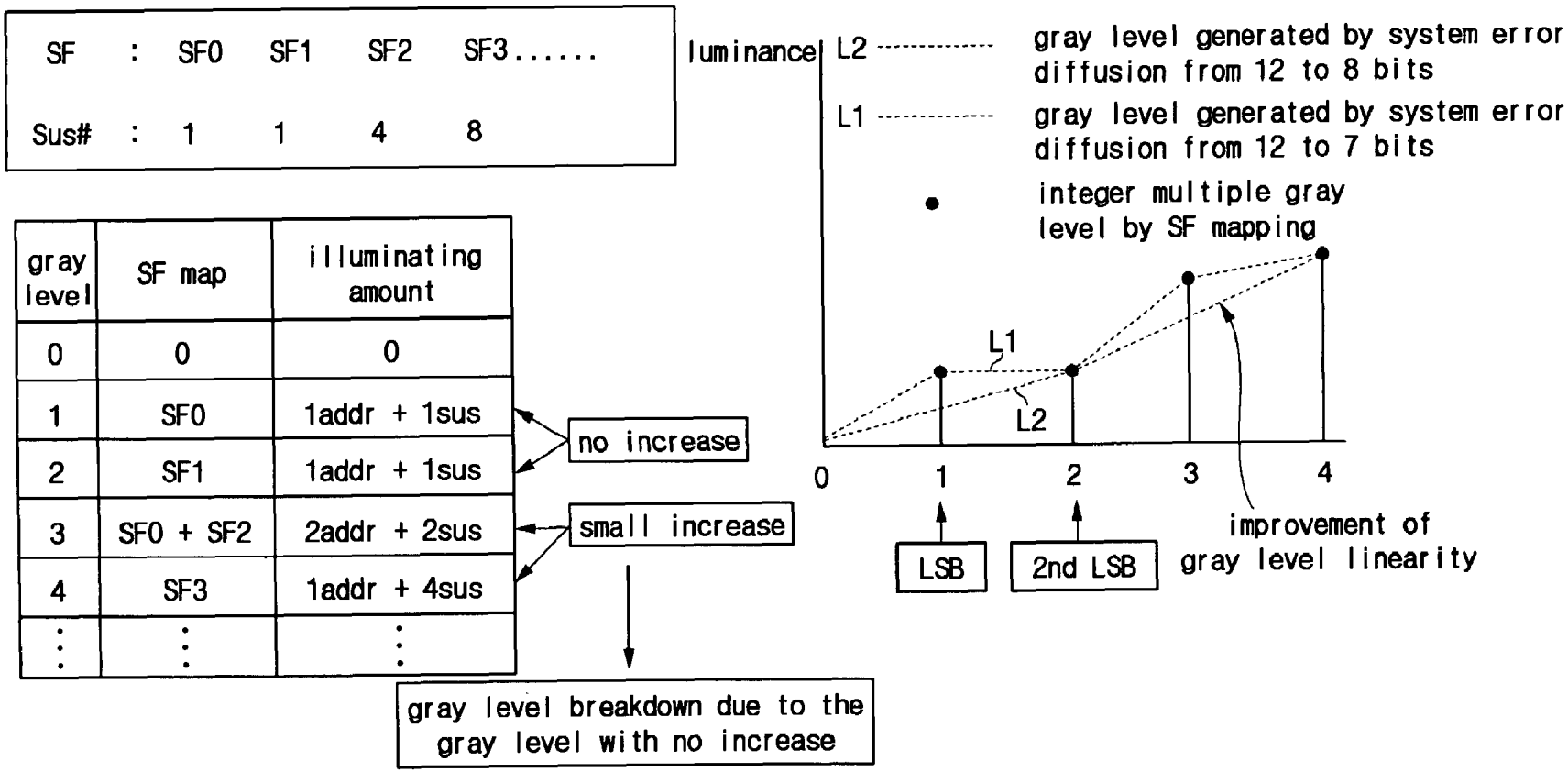
FIG. 4 is a view of an increase in luminance with respect to an increase in gray level according to a method of expressing gray level at a high load image according to an embodiment of the present invention.

FIG. 4 is a view of an increase in luminance with respect to an increase in gray level according to a method of expressing gray level at a high load image according to an embodiment of the present invention.

Referring to FIG. 4, the line L1, which shows the increase of luminance with respect to the increase of gray level on the basis of the illuminating amount determined by the subfields mapped with the respect gray levels and the number of sustain pulses assigned to the respect subfields as shown by FIGS. 2A and 2B, shows the breakdown of the linearity of gray level. According to the embodiment of the present invention, in order to make the line L2 that has linearity of luminance increase with respect to an increase of the gray level, the luminance without the linearity of gray level in the line L1 is located adjacent to the line L2 having the linearity.

Referring to FIG. 4, the linearity of the luminance increases with respect to the gray level increase in expressing the gray level of the high load image is due to the equality or similarity of the sustain pulses respectively assigned to the LSB subfield and the 2nd LSB subfield, and in particular, the linearity will deteriorate when the gray level to which the LSB subfield is mapped in the line L1, i.e. the gray level 1, is included. In other words, in the case of the high load image, when the number of sustain pulses is reduced so that the minimum sustain number is already assigned to the 2nd LSB subfield, even though the number of sustain pulses assigned to the LSB subfield which has less significance than the 2nd LSB should be smaller than one, one is inevitably assigned to the LSB subfield, so the linearity deteriorates at the gray level to which the LSB subfield is mapped.

Accordingly, in the embodiment of the present invention, the gray level linearity is improved by making the number of sustain pulses assigned to the subfield that deteriorates the gray level linearity when the gray level of the high load image is expressed, i.e. the LSB subfield, become substantially smaller than the number of sustain pulses assigned to the 2nd subfield.

In the above example, the number of sustain pulses assigned to the LSB subfield should be smaller than one as the number of sustain pulses assigned to the 2nd subfield is one. However, since the number of assigned sustain pulses cannot be smaller than one, the error diffusion is performed in the embodiment of the present invention with respect to the gray level bit including the gray level 1 to which the LSB subfield is mapped, i.e. the least significant bit LSB among the gray level data corresponding to the input image data, to make the number of sustain pulses assigned the LSB subfield at the gray level to which the LSB subfield is mapped when the gray level for respective pixels are expressed smaller than the integer multiple number of sustain pulses assigned to the 2nd LSB subfield.

In the embodiment of the present invention, the error diffusion is performed with respect to 12 bits generated by gamma correction to generate 8 bits of gray level data (which means the gray level data generated by the system error diffusion from 12 bits to 8 bits) in the case of a non-high load image. However, the LSB gray level is error-diffused to the vicinity during the error diffusion in the case of a high load image, and consequently, 7 bits of gray level data in which the LSB thereof is zero (which means the gray level data by the system error diffusion from 12 bits to 7 bits) are generated.

Figure 5:
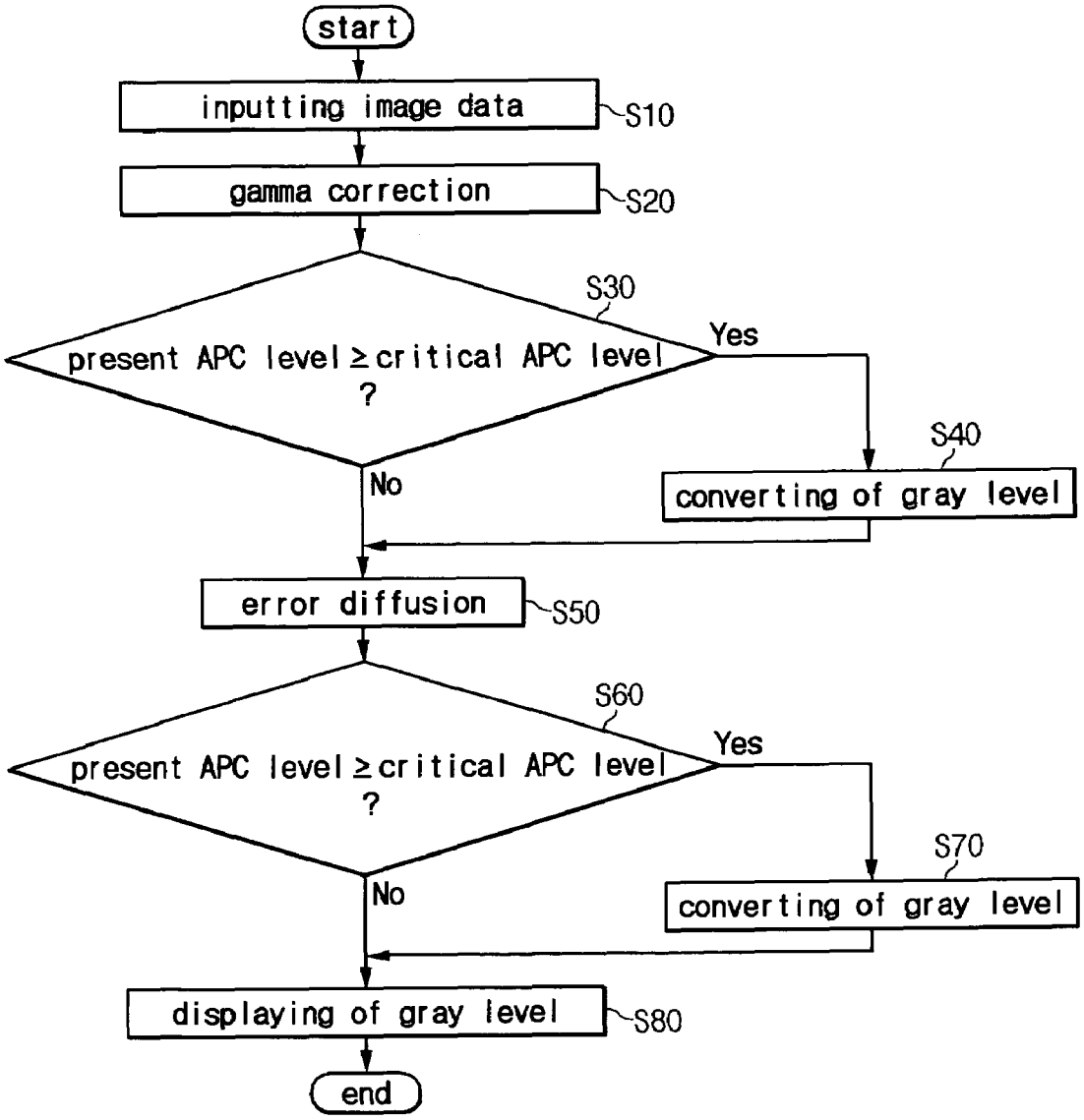
FIG. 5 is a flowchart of the gray level expressing method of a high load image according to an embodiment of the present invention.

FIG. 5 is a flowchart of the gray level expressing method of a high load image according to an embodiment of the present invention.

Referring to FIG. 5, in the method for expressing the gray level of a high load image according to the embodiment of the present invention, the image data corresponding to the high load image is input, and the gamma correction is performed in accordance with the characteristic of the PDP (S10 and S 20). In such a situation, the input image data is 8-bit data and the data is output as 12 bits of gray level data by the gamma correction.

Since the critical APC level in which the gray level linearity begins to break in the high load image is the APC level in which the numbers of sustain pulses respectively assigned to the LSB subfield and 2nd LSB subfield become equal to each other according to the corresponding APC level, a determination is made as to whether the present APC level determined by the load ratio of the gray level data generated by the gamma correction is greater than or equal to the critical APC level. (S30) In other words, a determination is made as to whether the present high load image is the high load level in which the gray level linearity breaks.

In the step 30, when the present APC level is greater than or equal to the critical APC level, the gray level data is converted to perform the system error diffusion from 12 bits to 8 bits. (S40) Such a conversion of the gray level data is performed by shifting the gray level data rightward at 1 bit to remove the LSB in 12 bits of gray level data and make the input of the leftmost bit (MSB) zero. If it is determined that the present APC level is smaller than the critical APC level in the step 30, 12 bits of gamma-corrected gray level data are output as is in order to perform the system error diffusion from 12 bits to 8 bits.

The error diffusion is performed with respect to the gray level data that has been changed in the step 40 or has been output as is in the step 30. Due to such an error diffusion, the LSB gray level data in which the gray level linearity breaks is error-diffused with respect to the gray level data that has been converted in the step 40, and consequently, the number of sustain pulses assigned to the LSB subfield corresponding to the gray level data of the respective pixels can be smaller than the integer multiple. The error-diffused gray level data is output as 8-bit data. Accordingly, when the gray level data has been converted in the step 40, only the remaining 7 bits excluding the MSB among the error-diffused gray level data becomes the real gray level data. Therefore, re-conversion of the gray level data described below is required.

A determination is made again as to whether the present APC level is greater than or equal to the critical APC level (S60), and when it is determined that the present APC level is greater than or equal to the critical APC level, the error-diffused gray level data is again converted by shifting the gray level data that has been shifted rightward for the error diffusion leftward again by one bit and setting the input of the LSB as zero. (S70) In the gray level data that has been converted in the step 40 and then re-converted after the error diffusion in the step 70, the LSB in which the linearity breaks is set to zero and the remaining bits excluding the LSB are restored to their original values. In such a situation, the removed original LSB has been error-diffused.

The high load image of which linearity has been improved can be displayed on the PDP by displaying the gray level data that has been re-converted in the step 70 or the gray level data that is output in the step 60 on the PDP (S80). FIGS. 6A1 and 6A2 show an example of real images that are displayed before and after the gray level expressing method according to the embodiment of the present invention is adopted to the low load image in which the APC level is smaller than 128 which is the exemplary critical APC level, in which the example according to the embodiment of the present invention is the same as that of the conventional art since the linearity does not break in the low gray level area at the low load image. However, as shown in FIGS. 6B1 and 6B2, when the APC level is greater than or equal to 128 which is the exemplary critical APC level at the high load image, the linearity breaks in the low gray level area to cause the breakdown of the gray level before the gray level expressing method according to the embodiment of the present invention is adopted. However, such a linearity is improved to cause the removal of the breakdown of the gray level after the gray level expressing method according to the embodiment of the present invention is adopted.

Hereinafter, the driving apparatus for a PDP using the gray level expressing method of the high load image according to the embodiment of the present invention is discussed.

Figure 7:
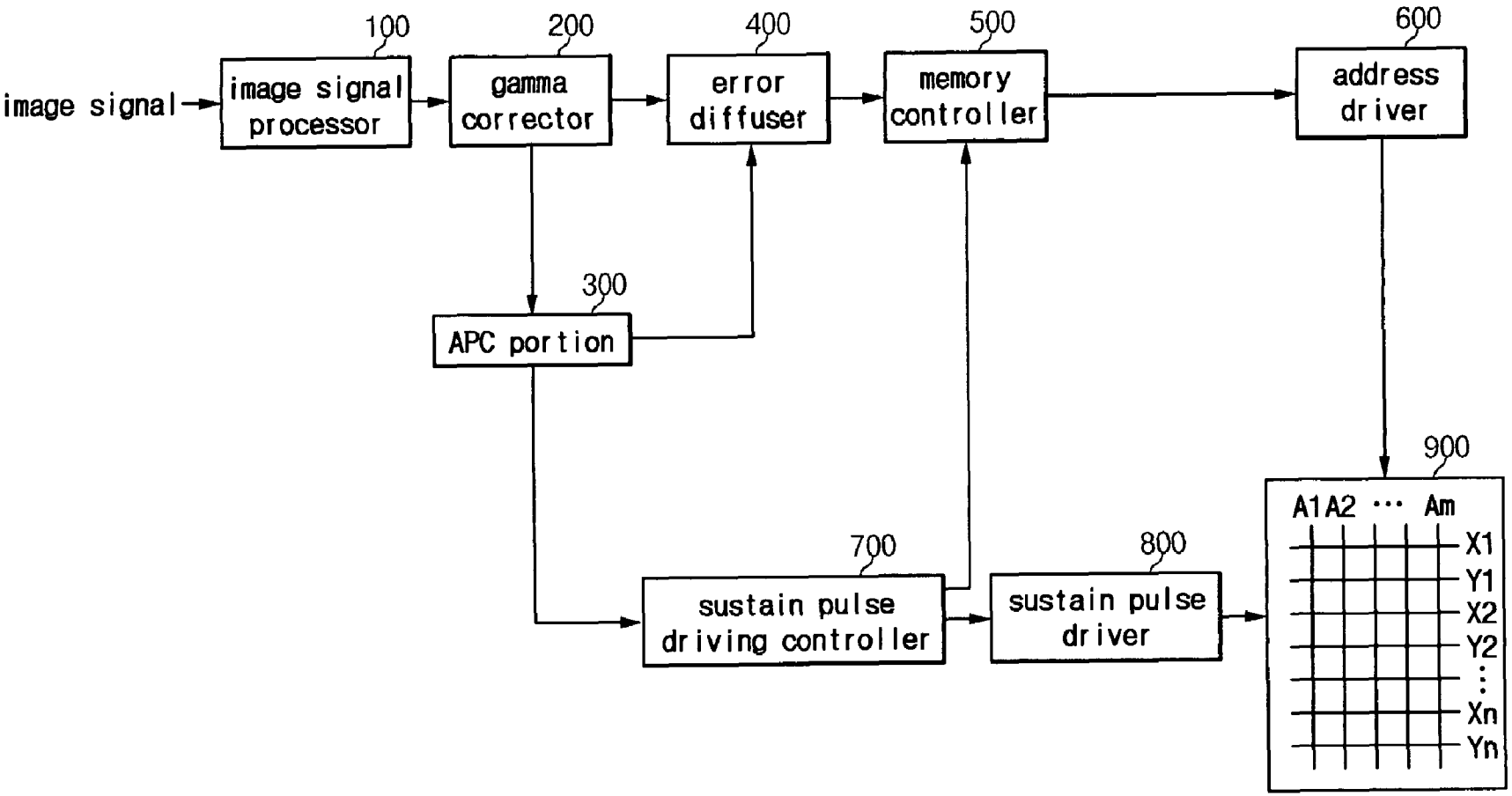
FIG. 7 is a block diagram of a PDP driving apparatus adapted to perform the high load image gray level expressing method according to an embodiment of the present invention.

FIG. 7 is a block diagram of a PDP driving apparatus performing the high load image gray level expressing method according to an embodiment of the present invention.

As shown in FIG. 7, the PDP driving apparatus performing the high load image gray level expressing method according to an embodiment of the present invention includes an image signal processor 100, a gamma corrector 200, an APC unit 300, an error diffuser 400, a memory controller 500, an address driver 600, a sustain pulse driving controller 700, and a sustain pulse driver 800.

The image signal processor 100 digitizes the image signal input from outside to generate 8 bits of digital image data.

The gamma corrector 200 receives the 8 bits of digital image data output from the image signal processor 100, and corrects the gamma value thereof in accordance with the characteristic of the PDP 900 to generate and output the 12 bits of gray level data.

The APC unit 300 detects the load ratio using the 12 bits of gray level data output from the gamma corrector 200, calculates the APC level according to the detected load ratio, and calculates and outputs the maximum number of sustain pulses, the number of subfield pulses assigned to the respect subfields, etc., corresponding to the calculated APC level. Furthermore, the APC unit 300 sets the minimum APC level among the APC levels in which the number of sustain pulses assigned to the LSB subfield is equal to the number of sustain pulses assigned to the 2nd LSB subfield as the critical APC level in advance, and then outputs the result of comparison between the preset critical APC level and the APC level calculated by the gray level data output from the gamma corrector 200.

The error diffuser 400 receives the 12 bits of gray level data output from the gamma corrector 200 and the APC comparison result output from the APC unit 300, and performs the process to diffuse the display error occurring during the conversion to the gray level that can be displayed on the PDP 900 to the neighboring pixels to generate the 8 bits of gray level data. In such a situation, when it is determined that the present calculated APC level is greater than or equal to the critical APC level according to the APC comparison result output from the APC unit 300, the gray level data conversion is performed in order to perform the error diffusion of the LSB of the 12 bits of gray level data output from the gamma corrector 200. Furthermore, after the error diffusion of the converted gray level data is performed, the error diffuser 400 re-converts the gray level data to recover the LSB to be zero.

It has been described above that the APC unit 300 compares the present calculated APC level with the critical APC level and the error diffuser 400 performs the gray level data conversion according to the comparison result of the APC unit 300. However, the present invention is not restricted to the above example, and many various modifications can be devised such that all of the APC comparison and the gray level data conversion are performed by the APC unit 300.

The memory controller 500 receives 8 bits of gray level data output from the error diffuser 400, and then generates the subfield data corresponding to the arrangement of the subfields output from the sustain pulse driving controller 700 with the 8 bits of gray level data.

The address driver 600 generates the address data corresponding to the subfield data generated by the memory controller 500 to apply to the address electrodes A1, A2, . . . , Am in the PDP 900.

The sustain pulse driving controller 700 generates the arrangement of the subfields corresponding to the maximum number of sustain discharge pulses output from the APC unit 300, the number of sustain pulses assigned to the respective subfields, etc., and then outputs them to the memory controller 500 and the sustain pulse driver 800.

The sustain pulse driver 800 generates the scan pulses and the sustain pulses based on the arrangement of the subfields output from the sustain pulse driving controller 700, and then applies them to the scan electrodes X1, X2, . . . , Xn and the sustain electrodes Y1, Y2, . . . , Yn, respectively.

The 8 bits of input image data has been gamma-corrected to be generated as 12 bits of gray level data in order to express the gray level in the above description. However, the present invention is not restricted to that example, and it can be easily understood by those with ordinary skill in the art that the input image data of various bit numbers can be generated and the gray level data of various bit numbers can be generated by the gamma correction of the input image data.

Furthermore, the high load image is determined by the comparison of the present calculated APC level with the critical APC level in the above description. However, since the APC level is determined on the basis of the load ratio, it can be easily understood by those with ordinary skill in the art that the high load image can be determined by the comparison of the present calculated load ratio with the critical load ratio at the critical APC level.

As described above, according to the present invention, the gray level linearity that can deteriorate when the low gray level is expressed can be improved since the number of sustain pulses is reduced while the gray level of the high load image is expressed by the PDP.

While this invention has been described in connection with exemplary embodiments, it is to be understood that the present invention is not limited to the these embodiments, but, on the contrary, is intended to cover various modifications and equivalent arrangements included within the spirit and scope of the appended claims.

What is claimed is:

1. A method of expressing gray level on a plasma display panel, the method comprising:

dividing an image of each field displayed on the plasma display panel in accordance with an input image signal into a plurality of different subfields and expressing the gray level by a combination of the different subfields;

calculating a load ratio of the input image signal;

performing error diffusion of a lower bit of the gray level data corresponding to the input image signal upon a determination that the calculated load ratio is greater than or equal to a critical load ratio which is a lowest load ratio among the load ratios in which luminance at every gray level does not increase while the gray level increases at a low gray level area; and displaying the error-diffused gray level data on the plasma display panel.

2. The method according to claim 1, wherein the luminance corresponding to the Least Significant Bit (LSB) gray level and the luminance corresponding to the 2nd LSB gray level are equal to each other at the critical load ratio.

3. The method according to claim 2, further comprising generating a gray level data corresponding to the input image signal by correcting a gamma value of the input image signal in accordance with a characteristic of the plasma display panel, after calculating the load ratio of the input image signal.

4. The method according to claim 1, further comprising generating gray level data corresponding to the input image signal by correcting a gamma value of the input image signal in accordance with a characteristic of the plasma display panel, after calculating the load ratio of the input image signal.

5. The method according to claim 4, wherein performing error diffusion of a lower bit of the gray level data comprises:

converting the gray level data to remove the LSB of the gray level data; and performing error diffusion of the converted gray level data.

6. The method according to claim 5, wherein converting the gray level data comprises:

shifting the gray level data in a direction toward the LSB; and inputting zero to a Most Significant Bit (MSB) of the gray level data.

7. The method according to claim 5, further comprising re-converting the gray level data after the error diffusion has been performed to set the LSB of the error-diffused gray level data equal to zero.

8. An apparatus for expressing a gray level on a plasma display panel, the apparatus comprising:

a gamma corrector adapted to correcting a gamma value of an input image signal in accordance with a characteristic of the plasma display panel to output gray level data corresponding to the image signal;

an Automatic Power Control (APC) unit adapted to detect a load ratio of the gray level data output from the gamma corrector, to calculate an APC level based on the detected load ratio, to calculate and output a number of sustain pulses corresponding to the calculated APC level and the numbers of sustain pulses assigned to respective subfields, to compare the calculated APC level with a critical APC level equal to a lowest APC level among APC levels in which luminance at every gray level does not increase while the gray level increases at a low gray level area, and to output the comparison result;

an error diffuser adapted to performing error diffusion of the gray level data output from the gamma corrector according to the comparison result, wherein gray level data corresponding to a Least Significant Bit (LSB) of the image signal is included in the error-diffused gray level data upon a determination that the calculated APC level is greater than or equal to the critical APC level according to the comparison result; and a driver adapted to receive the APC level and the number of sustain pulses output from the APC unit and the gray level data output from the error diffuser, to generate signals to display an image corresponding to the image signal on the plasma display panel, and to supply the generated signals to the plasma display panel.

9. The apparatus according to claim 8, wherein the driver comprises:

a sustain pulse driver adapted to generate a subfield arrangement according to the APC level and the number of sustain pulses output from the APC unit, to generate a control signal based on the generated subfield arrangement, and to supply the generated control signal to the plasma display panel; and a memory controller adapted to receive the gray level data output from the error diffuser, to generate the subfield data corresponding to the subfield arrangement generated by the sustain pulse driver, and to supply the generated subfield data to the plasma display panel.

10. The apparatus according to claim 8, wherein the error diffuser is adapted to perform the error diffusion after shifting the gray level data output from the gamma corrector in a direction toward the LSB by one bit to include the gray level data corresponding to the LSB of the image signal in the error diffusion.

11. The apparatus according to claim 10, wherein the error diffuser is adapted to shift the error-diffused gray level data again in a direction toward a Most Significant Bit (MSB) by one bit to restore all of the gray level data except the LSB.

12. A method of expressing a gray level on a plasma display panel, the method comprising:

dividing an image of each field displayed on the plasma display panel in accordance with an input image signal to a plurality of different subfields;

expressing the gray level by a combination of the different subfields;

calculating a load ratio of the input image signal;

determining whether a luminance at every gray level determined according to the calculated load ratio increases linearly according to a gradual increase of the gray level at a low gray level area;

performing error diffusion of the gray level data excluding the gray level data mapped commonly to the gray level corresponding to the luminance that does not increase linearly, upon a determination that the luminance at every gray level does not increase linearly according to a gradual increase of the gray level at a low gray level area; and displaying the error-diffused gray level data on the plasma display panel.

13. The method according to claim 12, wherein a determination is made that the luminance corresponding to a Least Significant Bit (LSB) gray level among the gray levels determined according to the calculated load ratio is equal to the luminance corresponding to the 2nd LSB gray level, to determine whether a luminance at every gray level determined according to the calculated load ratio increases linearly according to a gradual increase of the gray level at a low gray level area.

14. The method according to claim 13, wherein the error diffusion is performed with respect to the gray level data excluding the LSB upon the luminance corresponding to the LSB gray level being equal to the luminance corresponding to the 2nd LSB gray level.

* * * * *